US006031343A

United States Patent [19]

Recknagel et al.

[11] Patent Number: 6,031,343

[45] Date of Patent: Feb. 29, 2000

[54] BOWLING CENTER LIGHTING SYSTEM

[75] Inventors: Troy A. Recknagel, Muskegon; William O. Richardson, Grand Haven, both of Mich.

[73] Assignee: Brunswick Bowling & Billiards Corporation, Muskegon, Mich.

[21] Appl. No.: 09/038,449

[22] Filed: Mar. 11, 1998

[51] Int. Cl.[7] ..... G05F 1/00

[52] U.S. Cl. ..... 315/292; 315/295; 315/316; 315/324; 473/54; 473/113; 362/806

[58] Field of Search ..... 315/292, 295, 315/300, 316, 324; 473/54, 55, 110, 113, 115; 362/806, 811, 253

[56] References Cited

U.S. PATENT DOCUMENTS

| | | | |
|---|---|---|---|
| 3,301,558 | 1/1967 | Clapham | 273/51 |
| 4,302,010 | 11/1981 | Kaenel | 473/70 |
| 5,241,379 | 8/1993 | Tsujita | 348/157 |
| 5,420,482 | 5/1995 | Phares | 315/292 |
| 5,489,241 | 2/1996 | Perrier | 473/115 |
| 5,529,541 | 6/1996 | Perrier | 473/54 |
| 5,713,798 | 2/1998 | Brodie, Jr. | 473/55 |
| 5,800,274 | 9/1998 | Widrick et al. | 473/54 |

*Primary Examiner*—Haissa Philogene
*Attorney, Agent, or Firm*—Price, Heneveld, Cooper, DeWitt'& Litton

[57] ABSTRACT

The lighting system of the present invention includes at least one light string having a plurality of independently controllable light modules, each emitting light in response to an activation signal uniquely associated with the light module. The lighting system preferably includes a controller coupled to the light strings for generating and transmitting activation signals to the light modules to independently control the lights of the light modules. Each of the light modules may include a multi-color lighting device for emitting light of different colors such that the controller may select colors of the light emitted from each one of the light modules. The lighting system may also include a plurality of address modules each associated with and coupled to one of the light strings and coupled to the controller so that the controller may transmit activation signals to the light modules of a specific light string by transmitting an address to which the associated address module will respond by enabling the light modules of the associated light string to respond to the activation signals transmitted with the address signal from the controller.

48 Claims, 9 Drawing Sheets

BOWLING CENTER LIGHTING SYSTEM

BACKGROUND OF THE INVENTION

This invention generally relates to a wide-area graphic display system, and more particularly, pertains to a decorative lighting system for use in a bowling center.

Decorative lighting systems have been used in bowling centers in which light ropes are run along the bowling lane dividers so as to extend in parallel down the length of the bowling lanes. These light ropes include a plurality of spaced apart light bulbs provided along the length of the light rope. In general, such light ropes are only capable of providing a few light patterns. Aside from merely being all on or all off, the light bulbs in a light rope may be flashed on and off together, or may be turned on and off in a marquee style whereby every third or fourth light in the light rope is flashed on and off in parallel in a running sequence. Furthermore, the color of light emitted from the light rope from any one light bulb is fixed thereby significantly limiting the capabilities of such decorative lighting.

Although such light ropes are well-suited for running down the sides of each lane due to their linear nature, the limited capability of these light ropes does not allow for all such light ropes in the bowling center to be synchronized in any manner or otherwise produce any light show across the entire bowling center.

SUMMARY OF THE INVENTION

Accordingly, it is an aspect of the present invention to provide a lighting system that allows independent control of each lighting element of the system. Another aspect of the present invention is to provide a lighting system in which the color of each lighting element in the system may be independently selected and dynamically changed. Yet another aspect of the present invention is to provide a lighting system in which each of the lighting elements may be independently controlled by a control circuit so as to enable an unlimited number of graphic lighting patterns to be displayed. Still another aspect of the present invention is to provide a lighting system in which each of the lighting elements is independently addressable and the lighting elements are arranged in a plurality of linear strings so as to be well-suited for implementation along the division caps of a bowling center.

To achieve these and other aspects and advantages, the lighting system of the present invention comprises at least one light string including a plurality of independently controllable light modules each emitting light in response to an activation signal uniquely associated with the light module. The lighting system preferably includes a controller coupled to the light strings for generating and transmitting activation signals to the light modules to independently control the light modules. Each of the light modules may include a multi-color lighting device for emitting light of different colors such that the controller may select colors of the light emitted from each one of the light modules. The lighting system may also include a plurality of address modules each associated with and coupled to one of the light strings and coupled to the controller so that the controller may transmit activation signals to the light modules of a specific light string by transmitting an address to which the associated address module will respond by enabling the light modules of the associated light string to respond to the activation signals transmitted with the address signal from the controller.

The controller may include an interface, for connection to an external system, such as the bowling center's bowling scoring system. In this manner, the controller may generate a specific light display in response to signals received from this external system. For example, when a bowler rolls a strike, the bowling scoring system may signal the central controller of the lighting system to generate a pattern of lights along the lane on which the strike was rolled.

The controller of the inventive lighting system may also include an audio interface for coupling to an output of an audio device, such as the bowling center's audio system. With such an audio interface, the controller may operate in a music mode whereby the controller controls the lighting of each of the light modules in response to the audio signal received through the audio interface. In this manner, the lighting system may be synchronized with the music played throughout the bowling center.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
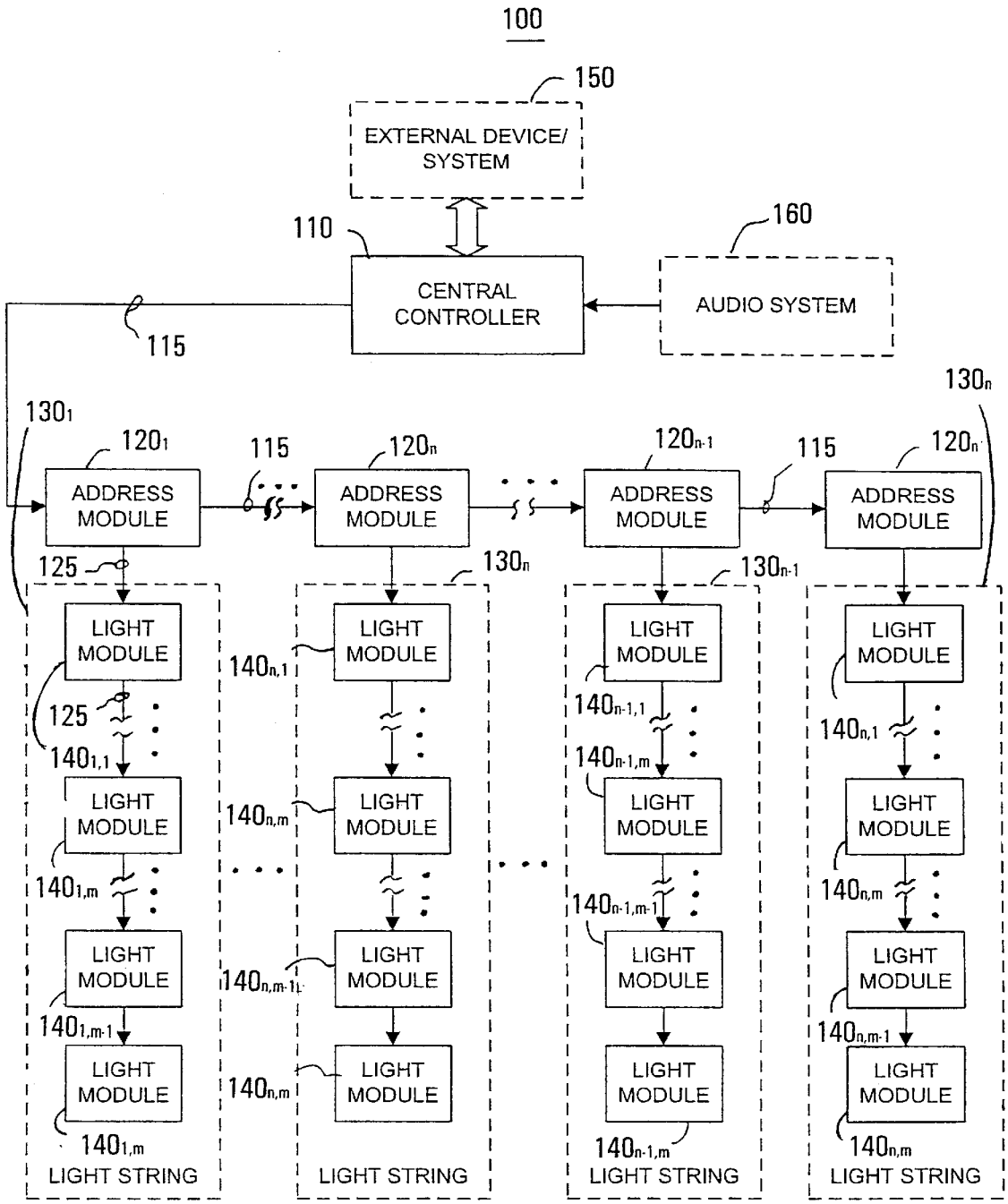
FIG. 1 is an electrical diagram of a lighting system constructed in accordance with the present invention.

FIG. 1 shows an example of a lighting system 100 constructed in accordance with the present invention. In general, lighting system 100 includes a central controller 110, a plurality of address modules $\mathbf{120}_1$ through $\mathbf{120}_N$ coupled to central controller 110 by a data cable 115, and a plurality of light strings $\mathbf{130}_1$ through $\mathbf{130}_N$, each associated with and coupled to one of address modules $\mathbf{120}_1$ through $\mathbf{120}_N$. Each light string $\mathbf{130}_n$ includes a plurality of light modules $\mathbf{140}_{n,l}$ through $\mathbf{140}_{n,M}$ coupled together in a linear fashion.

As will be explained in more detail below, central controller 110 may be coupled to an external device or system 150, such as the bowling center's bowling scoring system and/or may be coupled to an audio system 160, such as a bowling center's music system.

Figure 2:
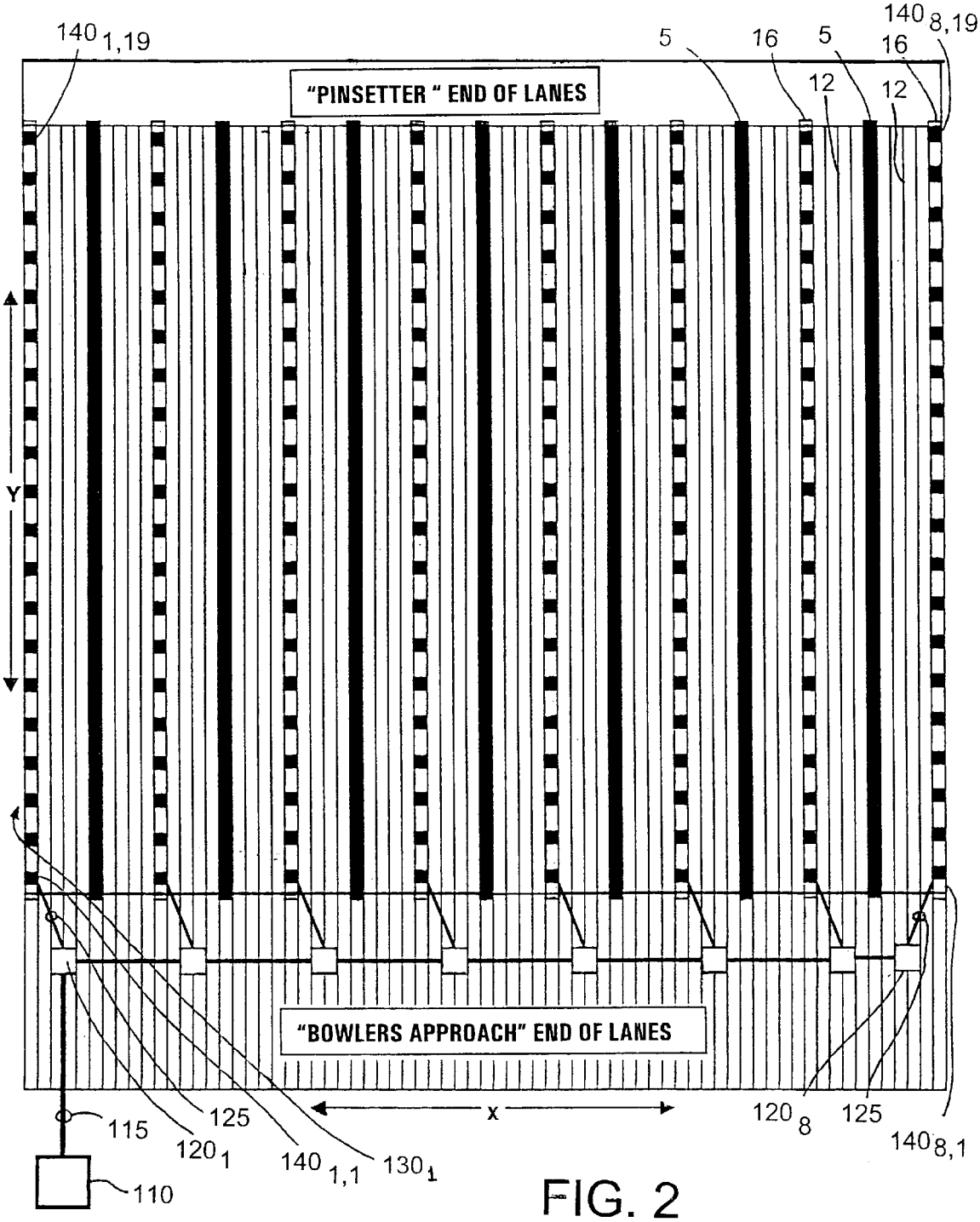
FIG. 2 is a perspective top view of the bowling lanes of a bowling center illustrating one possible implementation of the inventive lighting system.

FIG. 2 shows an example of how lighting system 100 may be implemented in a bowling center. As shown in FIG. 2, a bowling center typically includes a plurality of parallel lane surfaces 12. Such lane surfaces are typically grouped into pairs so as to share a common ball return. Between lanes constituting a pair is a ball return cap 5, which may take the form as disclosed in U.S. patent application Ser. No. 09/004,184 entitled BOWLING LANE BALL RETURN CAPPING, and filed on Jan. 8, 1998. Between the lanes associated with different lane pairs is a division member 16. The preferred structure for a division capping assembly 20 that is mounted on division member 16 is described below with reference to FIGS. 3 through 5. It is within the division capping assemblies 20 that the light strings 30 are preferably run. As further explained below, the division capping assemblies have a transparent cover to allow light projecting from the light modules 140 to be viewed by the bowlers and spectators.

As described above, each light string 130 is coupled to an address module $120_1$ through $120_8$, which are coupled to a central controller 110 via a data cable 115. The address modules may be mounted within the division capping assemblies, the bowling scoring consoles or anywhere else in proximity to one end of each light string. Conceivably, the address modules may be mounted behind the masking units and/or pinsetters. Central controller 110 may be disposed at the front desk of the bowling center, in a front office, or anywhere else in the bowling center.

Figures 3, 5:
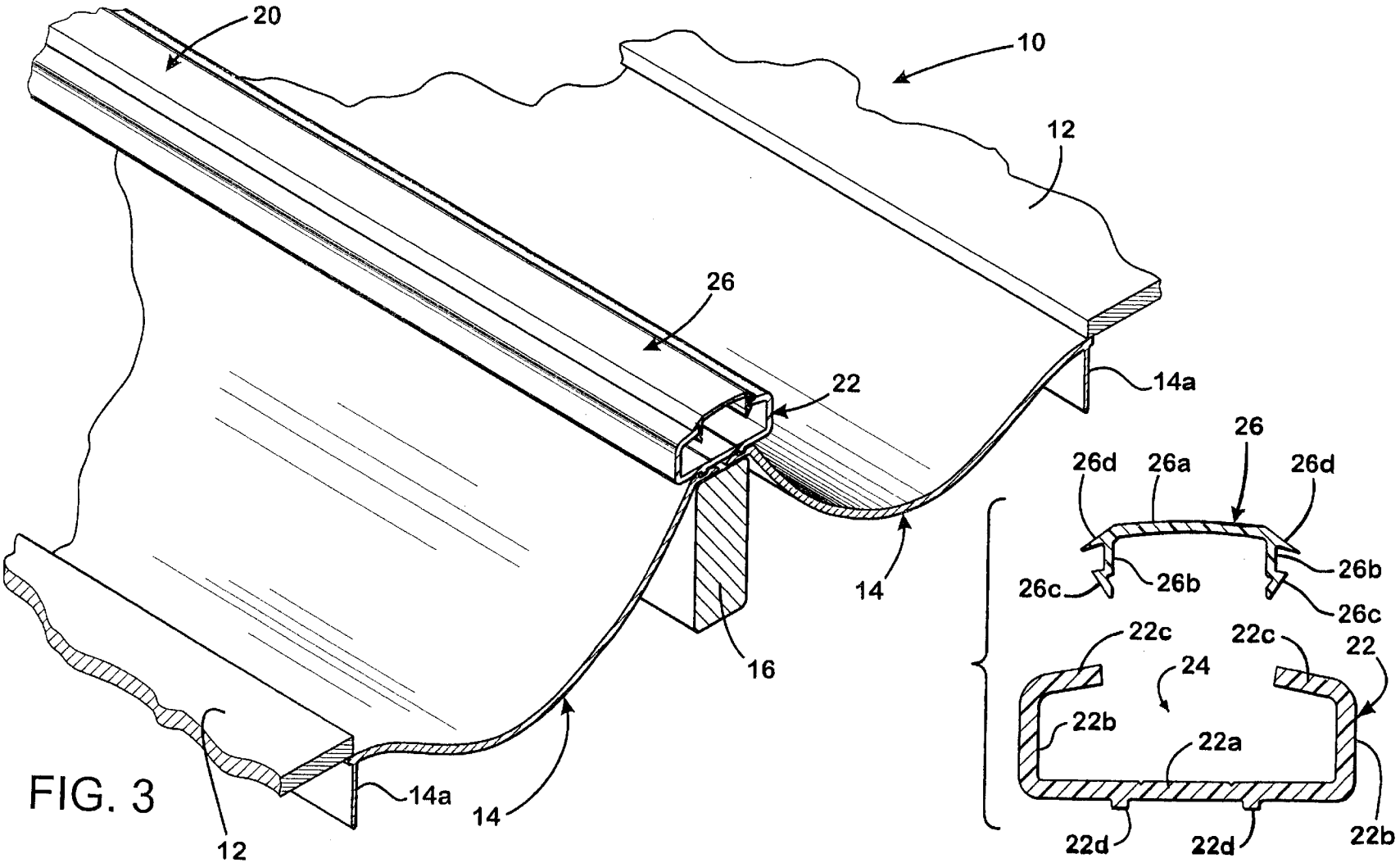
FIG. 3 is a perspective view of a division capping assembly in which light strings of the inventive lighting system may be mounted.
FIG. 5 is a sectional elevational exploded view of the two components of the division capping assembly shown in FIG. 3.
Figure 4:
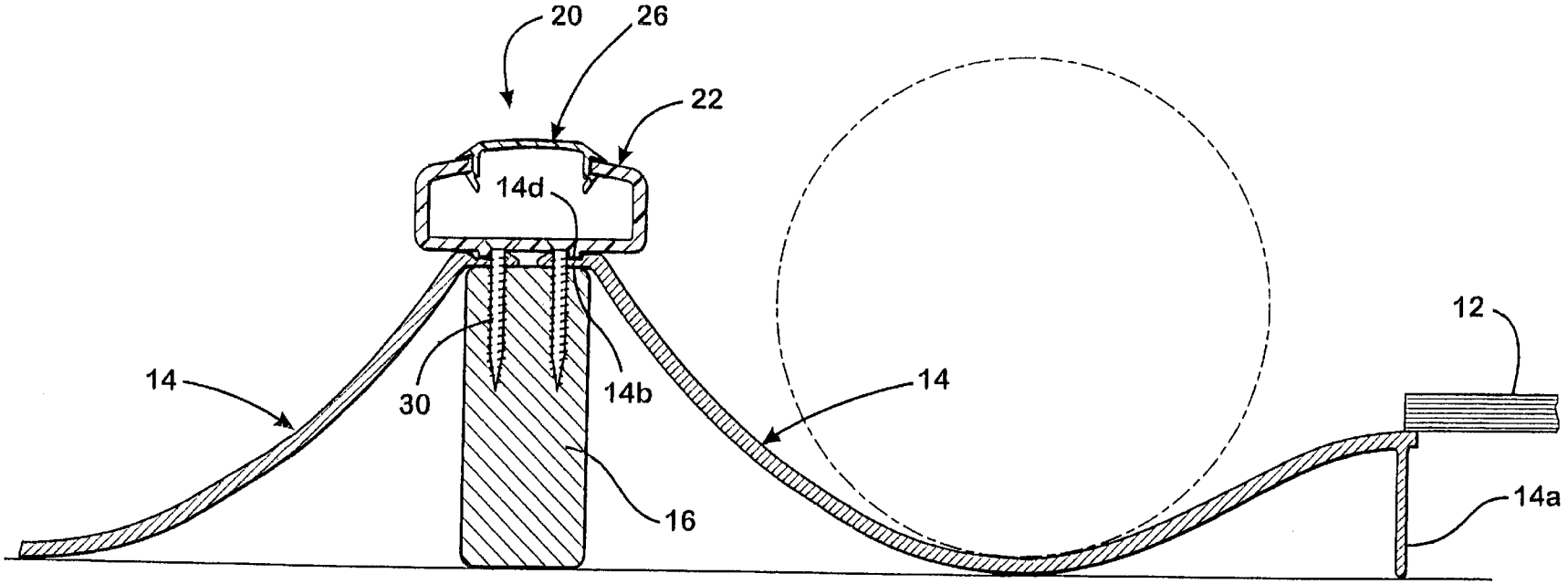
FIG. 4 is a sectional elevational view of a portion of the division capping assembly shown in FIG. 3.

As shown in FIGS. 3–5, and described in more detail in U.S. patent application Ser. No. 09/004,204 entitled BOWLING LANE DIVISION CAPPING and filed on Jan. 8, 1998, each bowling lane 12 has a lane surface 10 lying between a pair of lane-straddling gutters such that one gutter 14 of each lane 12 is immediately adjacent the gutter of the next lane, with a division member 16 therebetween. On the opposite side of each of the two lanes 12 depicted in FIG. 3 is the second gutter (not shown) which is adjacent the ball return, in conventional manner.

Preferably the gutter elements 14 have an upstanding support leg 14*a* adjacent lane 12 and a support flange 14*b* on the opposite edge of the gutter resting on division member 16. Flange 14*b* is interengaged with the lower member 22 of assembly 20, with both member 22 and the gutters being secured to division member 16 by threaded fasteners such as screws 30.

Lower member 22 is preferably an elongated extrusion element which runs the length of the bowling lane, preferably in segments thereof. This lower member has a lower, i.e., bottom, wall 22*a*, a pair of side walls 22*b* which extend integrally up from lower wall 22*a*, and a pair of upper flanges 22*c* which extend integrally from the upper ends of walls 22*b* generally toward each other but defining an open elongated channel 24 therebetween that serves as a convenient pathway for stringing the light strings 130. The side walls and flanges may be one continuous curve instead of extending upwardly and then inwardly. Protruding from the bottom of lower wall 22*a* are a pair of protrusion ribs 22*d* for engaging recess grooves in the respective adjacent edge portions of gutters 14. Alternatively, the recess grooves can be in member 22 and the protrusion ribs in flanges 22*c*.

The upper cap member 26 of assembly 20 comprises an upper wall 26*a* and a pair of spaced legs 26*b* depending downwardly from upper wall 26*a*. The cap may be in segments for easy handling and assembly. The legs 26*b* are spaced apart an amount about equal to the width of space 24, and have laterally outwardly offset detents 26*c* extending in opposite directions. The lower portions of these detents are sloped upwardly outwardly for engagement with flanges 22*c* whereby downward force applied to cap member 26 causes legs 26*b* to be shifted inwardly by flanges 22*c* against the inherent bias of the legs until detents 26*c* engage beneath the bottom surfaces of flanges 22*c*. The presently preferred polymer for the base member and the cap member is rigid polyvinylchloride (PVC) but could be a polyester or any other suitable polymer. The outer edges of upper wall 26*a* of cap 26 preferably have downwardly outwardly sloped tapered flanges 26*d* which are resiliently upwardly deformable slightly as detents 26*c* snap beneath flanges 22*c* for tight securement. Cap member 26 is translucent or transparent such that output from spaced lights located within the hollow assembly 20 will be viewable along the length of the bowling lanes to provide highly colorful effects. Conceivably, the lower member can also be translucent or transparent.

By using the above-described construction for the division capping assemblies 20, cap 26 may be readily removed and re-attached to allow the light strings to be easily strung along the length of the lane. Further, this division capping construction allows for quick access and replacement of the lighting modules. Although the light strings are described as being run within the division capping assemblies, the light strings may also be run on or within the ball return capping assemblies.

Figure 6:
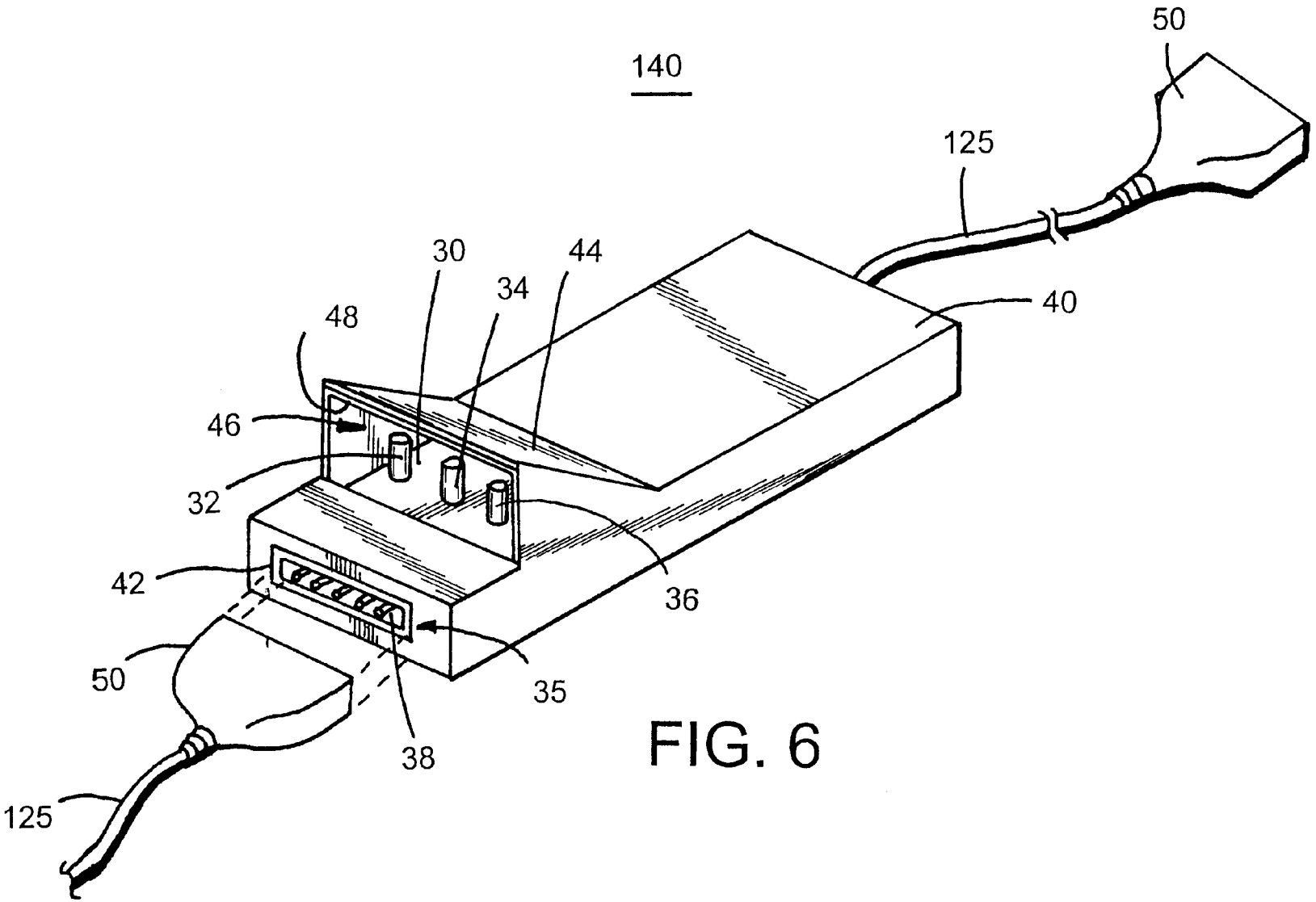
FIG. 6 is a perspective view of a light module that may be used in the inventive lighting system.

As shown in FIG. 6, each light module 140 may be formed on a circuit board 30 and mounted in a housing 40. Preferably, light module 140 includes a multi-color lighting device including three light emitting diodes (LEDs) or a single LED with multiple (3) colors as light sources. More preferably, these LEDs include a red LED 32, a green LED 34, and a blue LED 36. By providing red, green, and blue LEDs, which are the primary additive colors, each light module 140 may be controlled to emit not only one of the red, green, or blue colors, but also to emit white, cyan, yellow, or magenta when combinations of LEDs 32, 34, and 36 are illuminated.

To project the light from LEDs 32, 34, and 36, a portion 44 of the upper surface of housing 40 is sloped upward to define an opening 46 through which the light is projected. An inner surface of portion 44 preferably has a reflector 48 disposed thereon. In this manner, light modules 140 may be disposed within channel 24 so as to project the light back toward the approach area of the bowling lanes so as to appear more bright to the bowlers and spectators. Housing 40 may be provided with an aperture 42 defining a connection port 35 from which connector pins 38 extend from circuit board 30. Connector pins 38 are provided to allow coupling to a plug 50 of a wiring cable 125 which extends from the opposite end of the next light module 140. It will be appreciated that port 35 may be configured as a female port having receptacles rather than a male port having pins 38.

Light module housing 40 may also include a similar port at its opposite end for coupling to a wiring cable 125 of another light module 140 or may have the cable 125 more permanently mounted thereto. With a port 35 at one end and a cable 125 with a plug 50 provided at an opposite end, such light modules may be serially coupled together to form a light string. It will be appreciated, however, that wiring cables 125 may be permanently mounted to both ends of light module 140 so as to have a plurality of such light modules 140 permanently strung together. However, such a permanent mounting may be less desirable if it should become necessary to replace any one light module within the light string.

Figure 7:
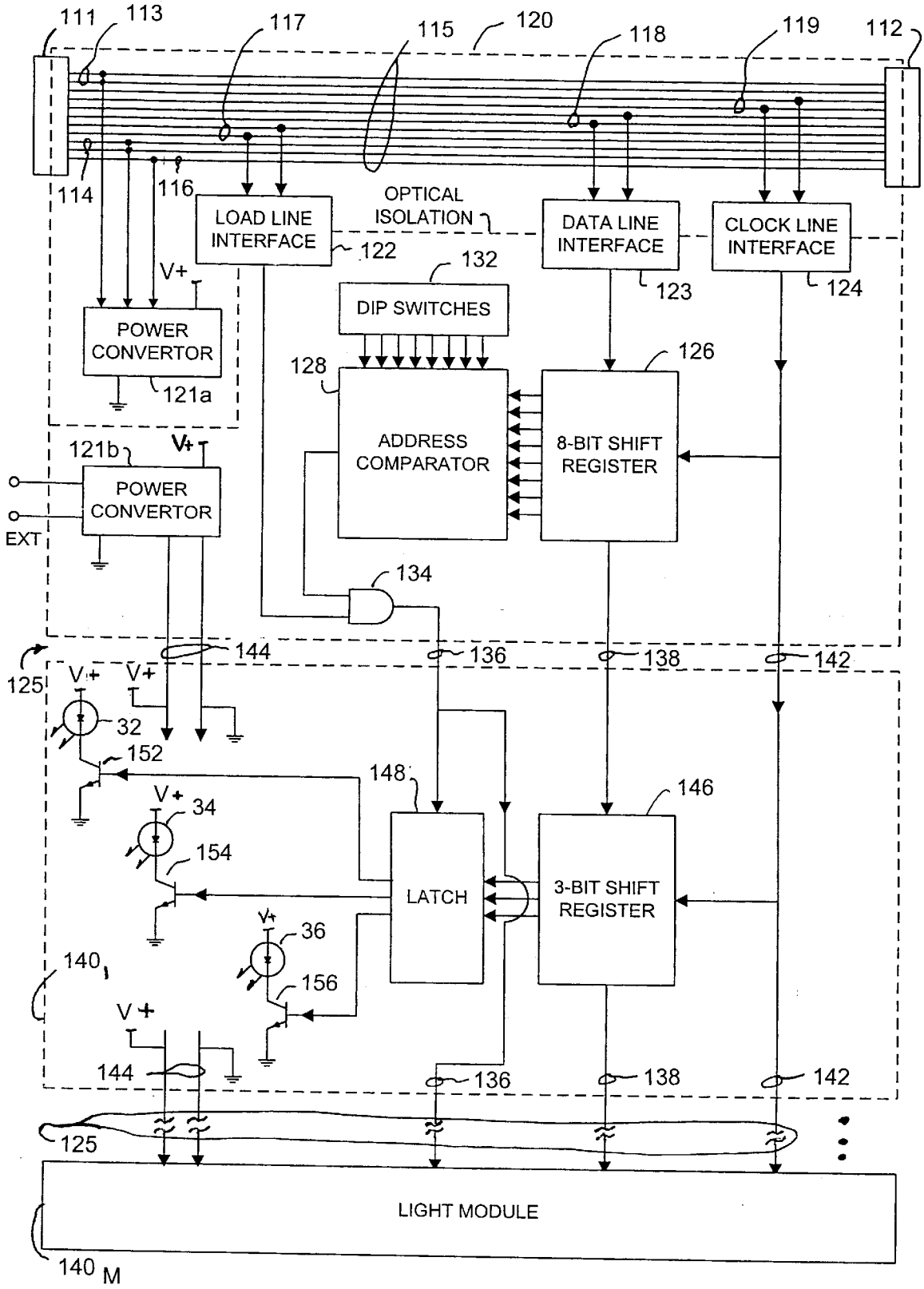
FIG. 7 is an electrical diagram in block form of an exemplary light string and address module of the inventive lighting system.

Having described the physical components of the lighting system of the present invention, the electrical and functional aspects of the inventive lighting system are described below with reference to FIGS. 7 through 9. As shown in FIG. 7, each address module 120 includes a pair of cable connectors 111 and 112 for coupling into and forming a part of data cable 115. It will be appreciated by those skilled in the art that connectors 111 and/or 112 may be mounted within an address module housing or be mounted at the end of a cable extension so as to mate with the connector of an upstream or downstream address module. As shown in FIG. 7, cable 115 includes power supply lines 113 for providing power to each address module system, ground lines 114, and an earth ground line 116. Further, cable 115 includes two lines 117 upon which is transmitted a differentiated load signal, a second pair of lines 118 upon which is transmitted a differentiated data stream, and a third pair of lines 119 upon which is transmitted a differentiated clock signal. The load signal, data stream, and clock signal are described in more detail below.

Address modules 120 also include a load line interface 122 coupled to line pair 117, a data line interface 123 coupled to line pair 118, and a clock line interface 124 coupled to line pair 119. Load, data, and clock line interfaces 122 through 124 receive the differentiated signals on the respective line pairs and generate a load signal, a data stream signal, and a clock signal, respectively. Preferably, these interfaces utilize an optical coupling so as to reduce the current drawn from bus 115.

Address modules 120 further include a first power converter 121*a* and a second power converter 121*b*. First power converter 121*a* is coupled to the ground and power lines of cable 115 for supplying power to those portions of interfaces 122, 123, and 124 that are coupled to cable 115. Second power converter 121*b* is provided to convert power received from an external power supply and supply power to light strings 130 and to those portions of interfaces 122, 123, and 124 that are optically isolated from cable 115. By using two power converters, the light strings may be isolated from cable 115.

The data stream signal as output from data line interface 123 is supplied to an 8-bit shift register 126. As the data stream signal is received by shift register 126, it is shifted through shift register 126 in response to the clock signal output from clock line interface 124. As data is shifted through register 126, it is passed along on line 138 of wiring cable 125 to the first light module $\mathbf{140}_1$ of the light string 130. This data is received by a 3-bit shift register 146, which shifts this data therethrough in response to the same clock signal to which 8-bit shift register 126 responds. As the data is shifted through 3-bit shift register 146, it is passed downstream to the 3-bit shift register of the next light module. When twenty light modules 140 are provided in a light string, the serially-connected 3-bit shift registers of each of the light modules 140 and the 8-bit shift register 126 of the associated address module 120, effectively operate as a 68-bit shift register. As such, new data may be loaded into the shift registers every 68 clock pulses. Thus, the first 60 bits of a data signal transmitted on line pair 118 will correspond to twenty 3-bit data signals used as activation signals to control the LEDs 32, 34, and 36 in each light module. The last 8 bits of the data stream will correspond to an address that is stored in 8-bit shift register 126.

Figure 8:
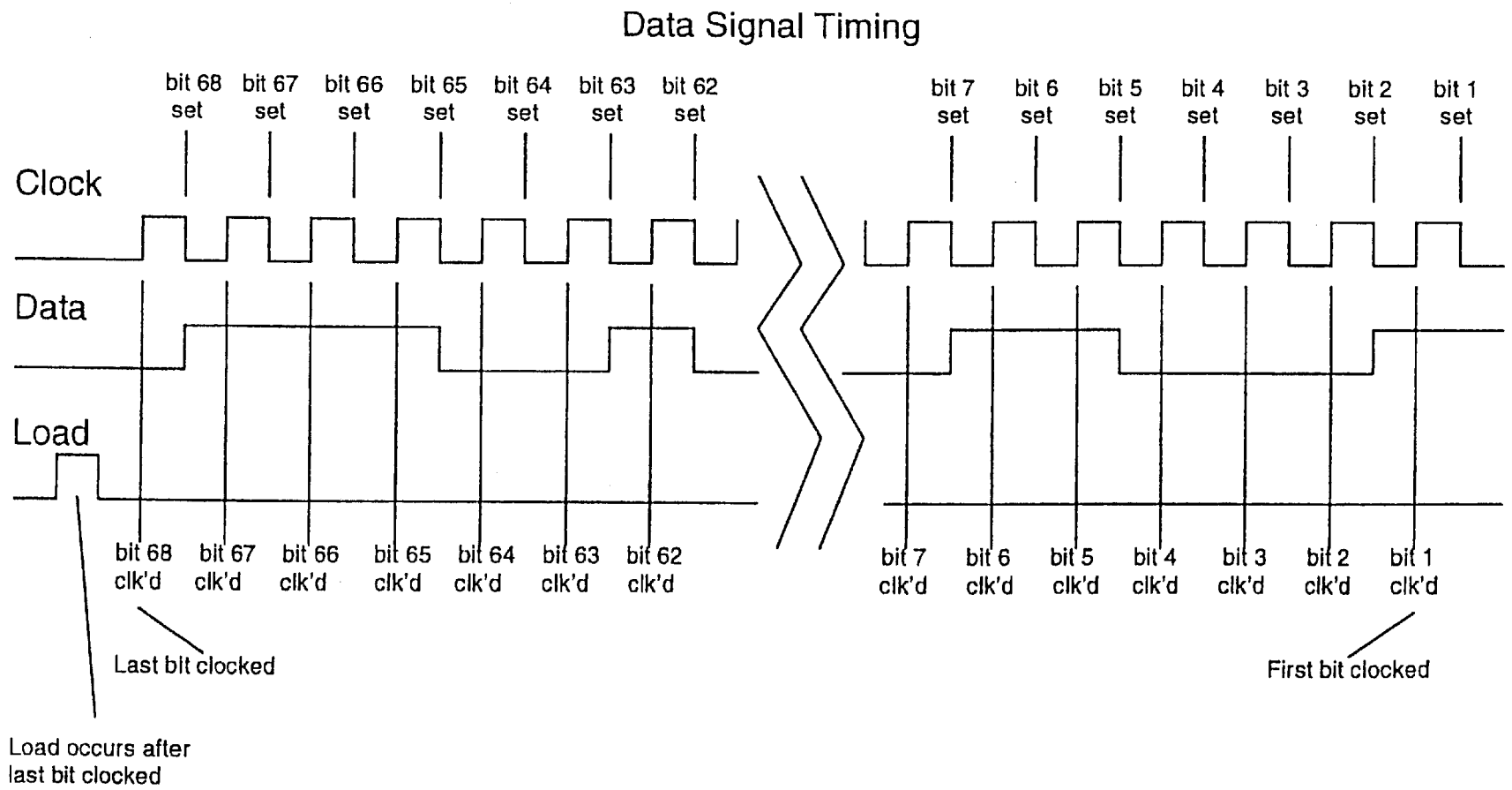
FIG. 8 is a timing chart representing the relative timings of the data, clock, and load signals that are transmitted by the inventive lighting system.

As shown in FIG. 8, for every 68-bit data signal that is clocked through 8-bit shift register 126 and the twenty 3-bit shift registers 146 of a light string, a load signal is transmitted on line pair 117. This load signal is supplied by load line interface 122 to an AND gate 134. The other input of AND gate 134 is coupled to the output of an address comparator 128 that compares the 8 bits that are stored in 8-bit shift register 126 at that time with an 8-bit address uniquely associated with address module 120. If the address in 8-bit shift register 126 corresponds to the unique address of the address module 120, address comparator 128 supplies a high logic level to AND gate 134 thereby enabling AND gate 134 to respond to the load signal by outputting the load signal on line 136 of wiring cable 125 to a latch circuit 148 of each light module 140. Latch circuit 148 is coupled between the 3-bit output of the 3-bit shift register 146 and three switching elements, such as transistors 152 through 156, which selectively activate a respective LED 32 through 36. Latch circuit 148 maintains LEDs 32 through 36 in their current illuminated state until such time that a load signal is received on line 136. When a load signal is received on line 136, latch circuit 148 applies the 3-bit output from 3-bit shift register 146 to switches 152, 154, and 156, respectively, to thereby change or maintain the illuminated states of LEDs 32, 34, and 36 in correspondence with the 3 bits of data that are stored in 3-bit shift register 146 at the time that the load signal was received on line 136.

If, on the other hand, the address comparator 128 determines that the 8 bits of data stored in 8-bit shift register 126 do not correspond to the unique 8-bit address of address module 120, address comparator 128 outputs a low logic level signal to AND gate 134 thereby preventing AND gate 134 from transmitting the load signal on line 136 when it is received from load line interface 122. Thus, unless the last 8 bits of the 68-bit data stream correspond to the unique address of the address module, the light string will not respond to the previously-transmitted 60 bits of data that have been shifted into the 3-bit shift registers 146 of light modules $\mathbf{140}_1$ through $\mathbf{140}_m$. As shown in FIG. 7, the unique address for the address modules may be selected using a plurality of DIP switches 132. Preferably, address comparator 128 also compares the 8-bit address stored in shift register 126 with a global address that is shared in common with all the address modules 120 of the lighting system. In this manner, central controller 110 may enable all the light strings to respond to a common data signal transmitted to all the light strings using one 68-bit data stream.

With the construction shown in FIG. 7, each LED of each light module of each light string may be independently controlled by central controller 110. Thus, controller 110 may control when, and for how long, each light module emits light. Controller 110 may also control the color of the light that is emitted from each light module. With such flexibility, central controller 110 can create a virtually unlimited number of lighting patterns on the light strings.

Although the lighting system has been described as utilizing 20 light modules per string and utilizing 8 bits of the data stream for an address, it will be appreciated by those skilled in the art that the number of light modules per string may be arbitrarily increased or decreased and that the number of bits per address may be varied as a function of the number of address modules/light strings that are provided. Further, given that the address modules 120 are daisy-chained together, an arbitrary number of such address modules may be connected into the system. Further, certain concepts embodied in the inventive lighting system may be implemented using more or less than three LEDs per module.

Having described the manner by which the address modules and light strings respond to the clock, data, and load signals transmitted by central controller 110, the manner in which central controller 110 selects which data to supply is described below with reference to FIG. 9.

Central controller 110 preferably includes a central processing unit (CPU) 200, a code memory 202, a data memory 204, a memory I/O decode logic circuit 206, a first output port (port 0) 208, a second output port (port 1) 210, an input port 212, a multi-point data cable interface 214, a front panel switch interface 216, configuration dip switches 218, a front panel display interface 220, a watchdog timer 222, and an EEPROM 224. CPU or processor 200 controls all the functions and operations of central controller 110. In general, processor 200 executes operating instructions stored in code memory 202 as received over a data bus 225 connected therebetween. Code memory 202 is preferably in the form of an EPROM. Code memory 202 also preferably stores numerous preprogrammed display patterns that may be read therefrom in any sequence in accordance with address signals received from processor 200 via an address bus 227. When a preprogrammed display pattern is read from code memory 202, it is transmitted over data bus 225 to first output port 208. First output port 208 creates the data stream that is transmitted to each of the addressable light strings via multi-point data cable interface 214 and data cable 115. First output port 208 also transmits a periodic strobe signal to watchdog timer 222. Watchdog timer 222 is provided to transmit a reset signal to processor 200 whenever a strobe signal is not received from first output port 208 within a predetermined time interval. In this manner, central controller 110 will not become locked up.

Memory I/O decode logic circuit 206 is provided to map all memory and I/O address locations. Circuit 206 is coupled to receive address signals from processor 200 or data memory 204 via address bus 227 and to receive read and write commands from processor 200. In response to information received at its inputs, decode logic circuit 206 transmits control signals to first and second output ports 208 and 210 that causes these output ports to output the data received on data bus 225 through their respective output lines. Further, decode logic circuit 206 may respond by sending a read signal to input port 212 to cause it to read inputs from front panel switch interface 216 or configuration dip switches 218 and to transmit these inputs on data bus 225 so that they may be received by processor 200. As will be explained further below, decode logic circuit 206 further transmits read and write signals to an analog-to-digital (A/D) converter 240 of an audio interface 228 to cause it to send or receive data on data bus 225.

Figure 9:
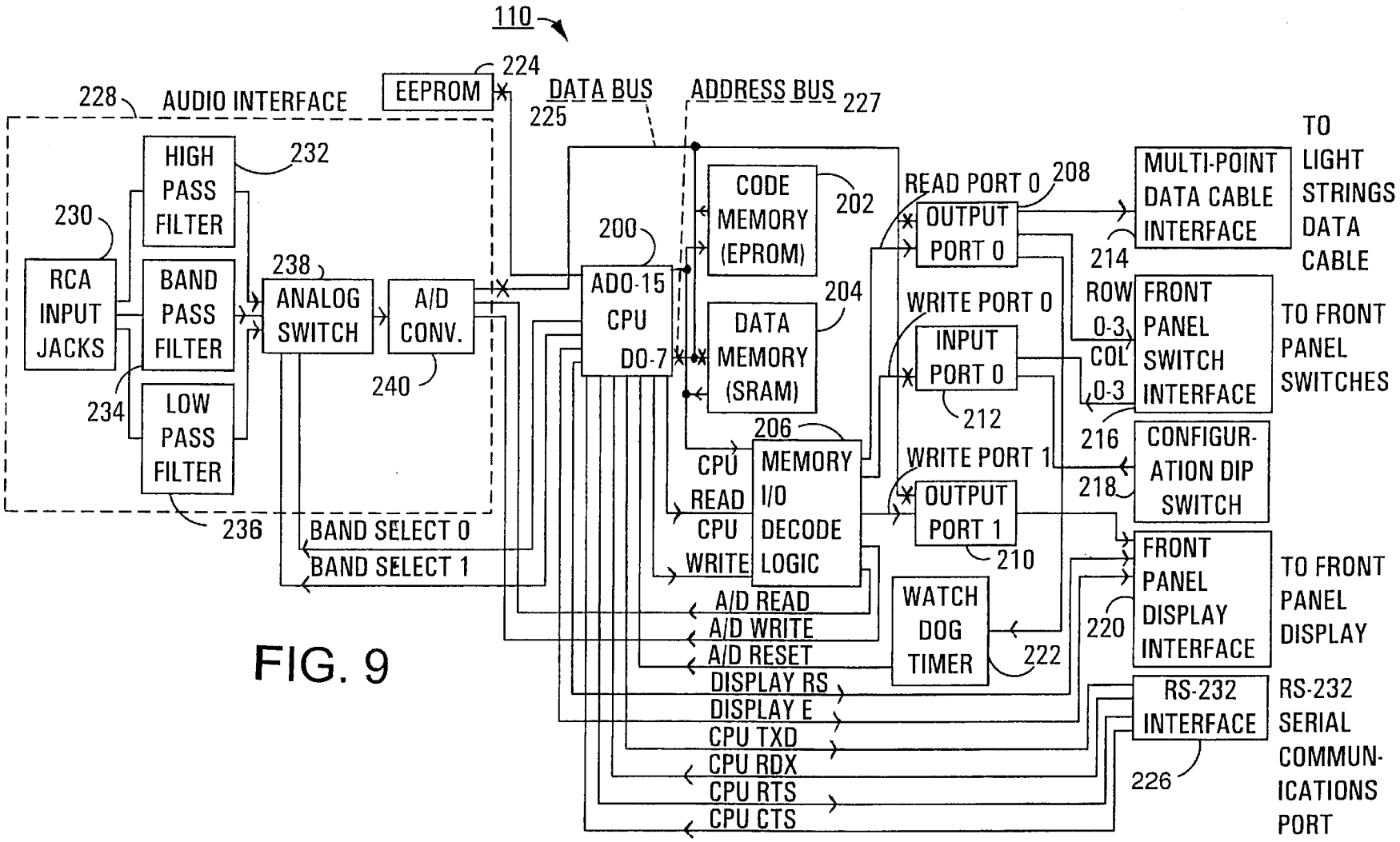
FIG. 9 is an electrical diagram in block form of an exemplary central controller of the inventive lighting system.

As shown in FIG. 9, central controller 110 may further include an external device interface 226 to which an external device, such as the bowling center's bowling scoring system, may be connected. Preferably, interface 210 is a standard RS-232 Serial Port and processor 200 includes a UART so as to enable any conventional personal computer (PC) or server to be connected to central controller 110. By connecting the bowling scoring system to external device interface 226, processor 200 may receive prompts from the scoring system that identify a particular lane or lane pair, and an event that occurred at the identified lane. For example, the bowling scoring system may inform central controller 110 that a strike has been rolled on lane 4. In such an event, central controller 110 could respond by transmitting data streams including the addresses for the two address modules on the adjacent borders of lane 4 so as to create a specific light show with respect to that lane. Thus, the light bordering that lane may be used to create a light show in synchronism with the exciter graphics shown on the scoring system displays.

Central controller 110 may further include an audio interface 228 which enables central controller 110 to interface with an audio device or system, such as the bowling center's audio system. Audio interface 228 preferably includes RCA input jacks 230 into which an audio line level signal may be received from the audio device or system. The line level signal is then split and applied to a high pass filter 232, a band pass filter 234, and a low pass filter 236. Filters 232, 234, and 236 are provided to separate the input audio signal into its treble, midrange, and bass frequency components. Although separation of the treble, midrange, and bass frequencies is disclosed, the audio signal could be separated into any number of different frequency bands. The outputs of each of these filters are applied to an analog switch 238, which is responsive to band select signals supplied from processor 200 to select one or more of the separated frequency components to supply to the input of A/D converter 240. A/D converter 240 converts the amplitude of the selected frequency component of the input audio signal into an 8-bit digital value. This 8-bit digital value may be output on data bus 225 and received by processor 200 when it receives a write-enable signal from decode logic circuit 206.

Through the operation of a switch on front panel switch interface 216 or the operation of a configuration dip switch 218, processor 200 may be set in a music mode whereby it instructs decode logic circuit 206 to enable A/D converter 240 to output a digital value representing the amplitude of a received audio signal on data bus 225. Processor 200 receives this digitized amplitude level and responds by selecting a light display data pattern that may vary in some respect as a function of the digitized amplitude level of the input audio signal. Further, as noted above, processor 200 may select either the treble, midrange, or base frequency component of the input audio so as to change the lighting patterns in response to either the amplitude of the base, midrange, or treble component levels. Thus, processor 200 may control the light patterns generated by the light strings in synchronism with the music played on the bowling center's audio system. Processor 200 may be configured so as to generate a lighting pattern in which the light strings are illuminated to simulate a power meter of, for example, a graphic equalizer, or may control the different LEDs of each light module so as to change color in response to the component amplitude levels of the input audio signal. The specific manner by which processor 200 responds to the input audio signal may be set by an operator through the actuation of a switch on front panel switch interface 216 or the operation of a dip switch 218. It will be appreciated by those skilled in the art that processor 200 may be programmed to respond to the input audio signal level to create virtually any sequence of lighting patterns in response to the characteristics of the input audio signal. It should further be noted that processor 200 may dynamically vary the band selection signal applied to analog switch 238 so as to modulate the different lights in each module in response to different frequency components of the input audio signal.

Front panel display interface 220 is preferably coupled to a display that is mounted in a location that may be viewed by the operator. By providing a display device, information, such as the operating mode, may be displayed to an operator. The information to be displayed on the display device may be transmitted from one of the memories or processor 200 over data bus 225 to output port 210, which, in turn, transmits the display information to front panel display interface 220 when a write-enable signal is received from decode logic circuit 206. The display device may further be controlled directly by processor 200, which is directly coupled to front panel display interface 220.

Data memory 204 is provided as a "scratch pad" memory for processor 200 and for storage of display patterns that may be downloaded via external device interface 226 from an external device. In this manner, the various lighting patterns that may be displayed by the lighting system may be varied at any time after installation of the system in a bowling center. EEPROM 224 is a nonvolatile memory used to store semi-permanent system configuration data that is utilized by processor 200.

Figure 10:
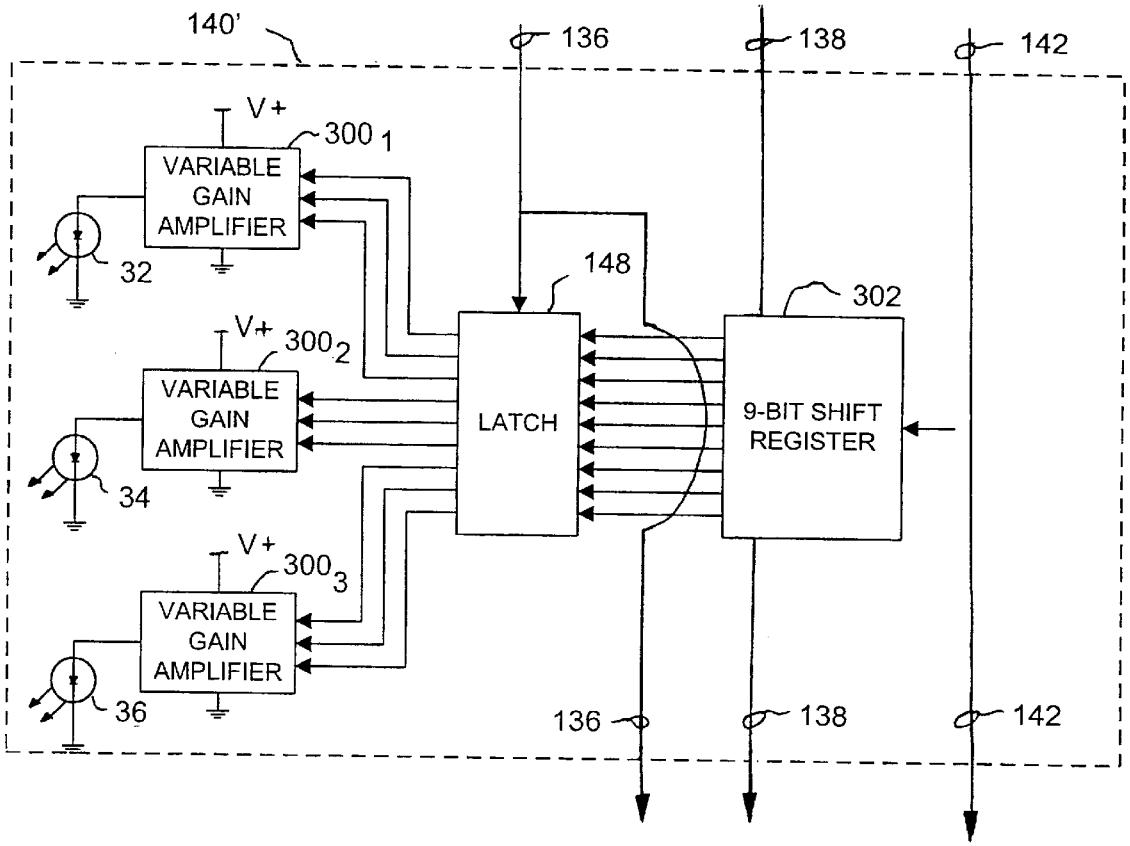
FIG. 10 is an electrical diagram in block form of an alternative embodiment of the light modules of the present invention.

According to an alternative embodiment shown in FIG. 10, the number of colors of light that may be emitted from each light module may be significantly increased by providing a variable gain amplifier 300 for each LED 32, 34, and 36, and by replacing the 3-bit shift registers in each light module 140 with 9-bit shift registers 302 so as to enable a 3-bit intensity level to be applied to each variable gain amplifier 300. In this manner, the intensity of the light emitted from each LED may be selectively controlled thereby enabling the saturation and hue of the light emitted from each light module to be controlled by the central controller.

Although the present invention has been described as being implemented in a bowling center, the light system could be employed in other locations or entertainment facilities. For example, the light modules could be embedded in a dance floor or the floor in a roller skating rink. Further, it should be noted that the light strings need not be arranged in parallel spaced lines, but instead may be laid out in a more serpentine fashion to form various shapes. Further, the light strings may be intertwined and intersect so long as the surface area on which they are mounted does not require that each light string is disposed in parallel spaced apart fashion as would be desired when mounting in the division caps of a bowling center. In this regard, it should also be noted that light strings may alternatively or additionally be mounted to the walls, masking unit, or ceiling of a bowling center. Such additional light strings could be controlled in synchronism by the same central controller used to control the lights in the division caps.

Given the flexibility provided by the lighting system of the present invention, the lighting system may be used to create graphic displays. For example, by arranging the light strings and light modules into a plurality of rows and columns (as would typically be the case when they are mounted in the division caps of a bowling center), a dynamic graphic display may be created through appropriate transmission of the data signals to the light modules. For example, the resulting two-dimensional array of light modules may be selectively illuminated in a dynamic fashion to display a game of PONG™ whereby the two outer light strings of the matrix are used to illuminate moving paddles and the remaining inner light strings may be used to create the illusion of a ball moving back and forth between the paddles. Moreover, given the ability of the lighting system to change the color of the light emitted from each light module, each light module may be viewed as a pixel of a wide-area graphic display. Such a wide-area graphic display may be used in virtually any location including placement on building exteriors and on billboards.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A lighting system for a bowling center having at least two bowling lanes divided by a lane pair divider, said lighting system comprising:

a light string disposed along a divider separating said bowling lanes, said light string including a plurality of independently controllable light modules each emitting light in response to an activation signal uniquely associated with the light module;

a controller coupled to said light string for generating and transmitting activation signals to said light modules to independently control said light modules; and a division capping assembly mounted on each lane pair divider, said division capping assembly defining a channel and having a transparent cover such that said light string may be run within said channel and the light from the light modules may be emitted through said transparent cover.

2. The lighting system as defined in claim 1, wherein each of said light modules includes a multi-color lighting device for emitting light of different colors such that said controller may select colors of the light to be emitted from each one of said light modules.

3. The lighting system as defined in claim 1, wherein said controller includes an interface for connecting to an external system, said controller being responsive to signals received from the external system for generating and transmitting activation signals to said light modules so as to create a selected lighting pattern.

4. The lighting system as defined in claim 1, wherein the light modules of said light string are coupled in series.

5. A lighting system for a bowling center having at least two bowling lanes, said lighting system comprising:

a light string disposed along a divider separating said bowling lanes, said light string including a plurality of independently controllable light modules each emitting light in response to an activation signal uniquely associated with the light module;

a controller coupled to said light string for generating and transmitting activation signals to said light modules to independently control said light modules; and a plurality of said light strings each disposed along different bowling lane dividers, and a plurality of address modules each coupled to one of said light strings and coupled to said controller, wherein said controller transmits activation signals to the light modules of a specific light string while transmitting therewith an address to which the address module associated with the specified light string will respond by enabling the light modules of the associated light string to respond to the activation signals transmitted from said controller.

6. A lighting system for a bowling center having at least two bowling lanes, said lighting system comprising:

a light string disposed along a divider separating said bowling lanes, said light string including a plurality of independently controllable light modules each emitting light in response to an activation signal uniquely associated with the light module; and a controller coupled to said light string for generating and transmitting activation signals to said light modules to independently control said light modules, wherein said controller includes an interface for connecting to an external system, said controller being responsive to signals received from the external system for generating and transmitting activation signals to said light modules so as to create a selected lighting display pattern on said light string.

7. A lighting system for a bowling center having at least two bowling lanes, said lighting system comprising:

a light string disposed along a divider separating said bowling lanes, said light string including a plurality of independently controllable light modules each emitting light in response to an activation signal uniquely associated with the light module; and a controller coupled to said light string for generating and transmitting activation signals to said light modules to independently control said light modules, wherein said controller includes an audio interface for connection of an output of an audio device, said controller generates and transmits activation signals to said light modules in order to generate a light pattern on said light string that changes in appearance in response to changes in a characteristic of an audio signal received from the audio device.

8. A wide-area decorative lighting system for a bowling center, said wide-area lighting system comprising:

a plurality of light strings each including a plurality of independently controllable light modules that emit light in response to an activation signal uniquely associated with each light module;

a plurality of address modules each associated with and coupled to one of said light strings; and a central controller coupled to said plurality of address modules for generating and transmitting activation signals to said light modules to independently control said light modules, wherein said central controller transmits activation signals to the light modules of a specific light string while transmitting therewith an address to which the address module associated with the specified light string will respond by enabling the light modules of the associated light string to respond to the activation signals transmitted from said central controller.

9. The wide-area lighting system as defined in claim 8, wherein each of said light modules includes a multi-color lighting device for emitting light of different colors such that said central controller may select colors of the light to be emitted from each one of said light modules.

10. The wide-area lighting system as defined in claim 8, wherein each of said light modules include a red LED, a green LED, and a blue LED, said LEDs being separately controllable such that said central controller may separately select one of at least seven different colors to be emitted from each of said light modules by transmitting an activation signal to selected ones or combinations of said red, green, and blue LEDs.

11. The wide-area lighting system as defined in claim 8, wherein said central controller includes an interface for connecting to an external system, said central controller being responsive to signals received from the external system for generating and transmitting activation signals to said light modules so as to create a selected graphic display pattern.

12. The wide-area lighting system as defined in claim 8, wherein said central controller includes an interface for connecting to a bowling scoring system, said central controller being responsive to signals received from said bowling scoring system for generating and transmitting activation signals to said light modules so as to create a selected graphic display pattern.

13. The wide-area lighting system as defined in claim 12, wherein said central controller is responsive to a signal from the bowling scoring system that identifies a bowling lane and an event that occurred at the identified bowling lane by generating and transmitting activation signals to light modules associated with the identified bowling lane so as to generate a lighting display pattern for the identified bowling lane.

14. The wide-area lighting system as defined in claim 8, wherein said central controller includes an audio interface for connection of an output of an audio device, said central controller generates and transmits activation signals to said light modules in order to generate a light pattern on said plurality of light strings that changes in appearance in response to changes in a characteristic of an audio signal received from the audio device.

15. The wide-area lighting system as defined in claim 8, wherein said central controller includes a memory for storing data representing a plurality of lighting patterns, said central controller selects one of the plurality of lighting patterns, reads the stored data representing the selected data pattern, and generates and transmits activation signals to said light modules in order to generate the selected light pattern on said plurality of light strings.

16. The wide-area lighting system as defined in claim 8, wherein said plurality of light strings are physically mounted in parallel to one another.

17. The wide-area lighting system as defined in claim 8, wherein said plurality of light strings are mounted in a single plane.

18. The wide-area lighting system as defined in claim 8, wherein the light modules of a light string are coupled in series.

19. The wide-area lighting system as defined in claim 8 and further including a plurality of division capping assemblies mounted on each lane pair divider, each of said division capping assemblies define a channel and have a transparent cover such that a light string may be run within said channel and the light from the light modules may be emitted through said transparent cover.

20. The wide-area lighting system as defined in claim 8, wherein the address module and the light modules of an associated light string include a serially connected shift registers responsive to a clock signal transmitted from said central controller to receive a data stream also transmitted from said central controller.

21. The wide-area lighting system as defined in claim 20, wherein said central controller transmits a load signal each time a data stream is transmitted, each said address module responds to the load signal by enabling the load signal to be transmitted to the associated light modules if the data stored in the shift register of the address module at the time the load signal is received corresponds to the unique address of the address module, whereby each of said light modules respond to said load signal by controlling the light emitted therefrom in accordance with the data stored in the shift register of the light module at the time the load signal is received.

22. A lighting system for a bowling center having at least two bowling lanes divided by a lane pair divider, said lighting system comprising:

a light string disposed along a divider separating said two bowling lanes, said light string including a plurality of light modules each including a multi-color lighting device for emitting light having one of a plurality of selectable colors; and a division capping assembly mounted on the lane pair divider, said division capping assembly defining a channel and having a transparent cover such that said light string may be run within said channel and the light from the light modules may be emitted through said transparent cover.

23. The lighting system as defined in claim 22, wherein each of said light modules includes a red LED, a green LED, and a blue LED, said LEDs being independently activated in response to an activation signal.

24. The lighting system as defined in claim 22 and further including a controller coupled to said light string for generating and transmitting activation signals to said light modules to independently activate said light sources of said light modules.

25. A wide-area graphic display system comprising:

a plurality of light strings each including a plurality of independently controllable light modules that emit light in response to an activation signal uniquely associated with each light module;

a plurality of address modules each associated with and coupled to one of said light strings; and a central controller coupled to said plurality of address modules for generating and transmitting activation signals to said light modules to independently control said light modules, wherein said central controller transmits activation signals to the light modules of a specific light string while transmitting therewith an address to which the address module associated with the specified light string will respond by enabling the light modules of the associated light string to respond to the activation signals transmitted from said central controller to thereby generate a graphic display.

26. The wide-area graphic display system as defined in claim 25, wherein each of said light modules includes a multi-color lighting device for emitting light of different colors such that said central controller may select colors of the light to be emitted from each one of said light modules.

27. The wide-area graphic display system as defined in claim 25, wherein each of said light modules include a red LED, a green LED, and a blue LED, said LEDs being separately controllable such that said central controller may separately select one of at least seven different colors to be emitted from each of said light modules by transmitting an activation signal to selected ones or combinations of said red, green, and blue LEDs.

28. The wide-area graphic display system as defined in claim 25, wherein said central controller includes an audio interface for connection of an output of an audio device, said central controller generates and transmits activation signals to said light modules in order to generate a light pattern on said plurality of light strings that changes in appearance in response to changes in a characteristic of an audio signal received from the audio device.

29. The wide-area graphic display system as defined in claim 25, wherein said central controller includes a memory for storing data representing a plurality of lighting patterns, said central controller selects one of the plurality of lighting patterns, reads the stored data representing the selected data pattern, and generates and transmits activation signals to said light modules in order to generate the selected light pattern on said plurality of light strings.

30. The wide-area graphic display system as defined in claim 25, wherein said plurality of light strings are physically mounted in parallel to one another.

31. The wide-area graphic display system as defined in claim 25, wherein said plurality of light strings are mounted in a single plane.

32. The wide-area graphic display system as defined in claim 25, wherein the light modules of a light string are coupled in series.

33. The wide-area graphic display system as defined in claim 25 and further including a plurality of division capping assemblies mounted on each lane pair divider, each of said division capping assemblies define a channel and have a transparent cover such that a light string may be run within said channel and the light from the light modules may be emitted through said transparent cover.

34. The wide-area graphic display system as defined in claim 25, wherein the address module and the light modules of an associated light string include a serially connected shift registers responsive to a clock signal transmitted from said central controller to receive a data stream also transmitted from said central controller.

35. The wide-area graphic display system as defined in claim 34, wherein said central controller transmits a load signal each time a data stream is transmitted, each said address module responds to the load signal by enabling the load signal to be transmitted to the associated light modules if the data stored in the shift register of the address module at the time the load signal is received corresponds to the unique address of the address module, whereby each of said light modules respond to said load signal by controlling the light emitted therefrom in accordance with the data stored in the shift register of the light module at the time the load signal is received.

36. A bowling center lighting system comprising:

a plurality of addressable light strings each including a plurality of independently controllable light modules that emit light in response to an activation signal uniquely associated with each light module; and a controller coupled to said addressable light strings and having a memory for storing data representing a plurality of lighting patterns, said controller selects one of the plurality of lighting patterns, reads the stored data representing the selected data pattern, and generates and transmits activation signals to said light modules in order to generate the selected light pattern on said plurality of light strings.

37. The bowling center lighting system as defined in claim 36, wherein said controller includes an audio interface for connection of an output of an audio device, said controller generates and transmits activation signals to said light modules in order to generate a light pattern on said plurality of light strings that changes in appearance in response to changes in a characteristic of an audio signal received from the audio device.

38. The bowling center lighting system as defined in claim 36, wherein each of said light modules includes a multi-color lighting device for emitting light of different colors such that said controller may select colors of the light to be emitted from each one of said light modules.

39. The bowling center lighting system as defined in claim 36, wherein said controller includes an interface for connecting to a bowling scoring system, said controller being responsive to signals received from said bowling scoring system for generating and transmitting activation signals to said light modules so as to create a selected graphic display pattern.

40. A bowling center lighting system comprising:

a plurality of addressable light strings each including a plurality of independently controllable light modules that emit light in response to an activation signal uniquely associated with each light module; and a control circuit coupled to said addressable light strings and having an audio interface for connection an output of an audio device, said control circuit generates and transmits activation signals to said light modules in order to generate a light pattern on said plurality of light strings that changes in appearance in response to changes in a characteristic of an audio signal received from the audio device.

41. The bowling center lighting system as defined in claim 40, wherein each of said light modules includes a multi-color lighting device for emitting light of different colors such that said control circuit may select colors of the light to be emitted from each one of said light modules.

42. The bowling center lighting system as defined in claim 41, wherein said control circuit includes an interface for connecting to a bowling scoring system, said control circuit being responsive to signals received from said bowling scoring system for generating and transmitting activation signals to said light modules so as to create a selected graphic display pattern.

43. The bowling center lighting system as defined in claim 41, wherein said control circuit includes a memory for storing data representing a plurality of lighting patterns, said control circuit selects one of the plurality of lighting patterns, reads the stored data representing the selected data pattern, and generates and transmits activation signals to said light modules in order to generate the selected light pattern on said plurality of light strings.

44. A lighting system for a bowling center having an automatic scoring system, said lighting system comprising:

a plurality of addressable light strings each including a plurality of independently controllable light modules that emit light in response to an activation signal uniquely associated with each light module; and a control circuit coupled to said addressable light strings and having an interface for connection the automatic scoring system, wherein said control circuit is responsive to signals received from said automatic scoring system for generating and transmitting activation signals to said light modules so as to create a selected graphic display pattern.

45. The lighting system as defined in claim 44, wherein said control circuit is responsive to a signal from the automatic scoring system that identifies a bowling lane by creating a light show on the light strings bordering the identified lane.

46. The lighting system as defined in claim 44, wherein said control circuit is responsive to a signal from the automatic scoring system that identifies a bowling lane and an event that occurred on the identified bowling lane by selecting a display pattern associated with the identified event creating a light show having the selected display pattern on the light strings bordering the identified lane.

47. The lighting system as defined in claim 44, wherein said control circuit includes an audio interface for connection of an output of an audio device, said control circuit generates and transmits activation signals to said light modules in order to generate a light pattern on said plurality of light strings that changes in appearance in response to changes in a characteristic of an audio signal received from the audio device.

48. The lighting system as defined in claim 44, wherein each of said light modules includes a multi-color lighting device for emitting light of different colors such that said control circuit may select colors of the light to be emitted from each one of said light modules.

* * * * *

UNITED STATES PATENT AND TRADEMARK OFFICE

CERTIFICATE OF CORRECTION

PATENT NO. : 6,031,343
DATED : February 29, 2000
INVENTOR(S) : Troy A. Recknagel et al It is certified that error appears in the above-identified patent and that said Letters Patent is hereby corrected as shown below:

Column 12, claim 20,
Line 45: "a serially" should be -- serially -- ;

Column 14, claim 34,
Line 13: "a serially" should be -- serially -- ;

Claim 40,
Line 67: After "connection" insert -- of-- ;

Column 15, claim 44,
Line 34: "connection" should be -- connecting -- .

Signed and Sealed this

Fourth Day of September, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,031,343
DATED : February 29, 2000
INVENTOR(S) : Troy A. Recknagel et al.

It is certified that error appears in the above-identified patent and that said Letters Patent is hereby corrected as shown below:

Title page,
The following U.S. PATENT DOCUMENTS, should be added:

| | | |
|---|---|---|
| -- 3,789,211 | 1/1974 | Kramer |
| 4,388,567 | 6/1983 | Yamazaki et al. |
| 4,464,606 | 8/1984 | Kane |
| 4,467,246 | 8/1984 | Tanaka et al. |
| 4,733,103 | 3/1988 | Itoh et al. |
| 4,792,731 | 12/1988 | Pearlman et al. |
| 4,980,806 | 12/1990 | Taylor |
| 4,992,704 | 2/1991 | Stinson |
| 5,059,871 | 10/1991 | Pearlman et al. -- |

Signed and Sealed this

Nineteenth Day of February, 2002

*Attest:*

*Attesting Officer*

JAMES E. ROGAN
*Director of the United States Patent and Trademark Office*